United States Patent [19]

Foster

[11] 4,208,374

[45] Jun. 17, 1980

[54] CATALYTIC CONVERTER

[75] Inventor: Michael R. Foster, Columbiaville, Mich.

[73] Assignee: General Motors Corporation, Detroit, Mich.

[21] Appl. No.: 847,406

[22] Filed: Oct. 31, 1977

[51] Int. Cl.[2] ..... B01J 8/02; F01N 3/15; F01N 7/18

[52] U.S. Cl. ..... 422/179; 422/181; 60/299; 29/157 R; 29/163.5 R; 29/455 R

[58] Field of Search ..... 23/288 F, 288 FC, 288 FB, 23/288 FA; 422/179, 181; 60/299; 29/157 R, 163.5 R, 163.5 F, 455 R

[56] References Cited

U.S. PATENT DOCUMENTS

| | | | |
|---|---|---|---|
| 3,239,317 | 3/1966 | Rhodes | 23/288 F |
| 3,594,131 | 7/1971 | De Palma et al. | 60/299 |
| 3,600,142 | 8/1971 | Fessler | 23/288 F |
| 3,637,353 | 1/1972 | Smithson et al. | 23/288 F |
| 3,685,972 | 8/1972 | De Palma et al. | 23/288 F |
| 3,852,041 | 12/1974 | Mooreet al. | 23/288 F |
| 3,854,888 | 12/1974 | Frietzsche et al. | 23/288 F |
| 3,912,459 | 10/1975 | Kearsley | 252/477 R |
| 3,938,232 | 2/1976 | Noda et al. | 29/157 R |
| 3,950,139 | 4/1976 | Cannon | 23/288 F |
| 3,957,446 | 5/1976 | Mayer et al. | 23/288 F |
| 3,978,567 | 9/1976 | Vroman | 60/299 |
| 3,990,859 | 11/1976 | Waite | 29/157 R |
| 4,005,576 | 2/1977 | Nohira et al. | 23/288 F |
| 4,020,539 | 5/1977 | Vroman | 60/299 |

FOREIGN PATENT DOCUMENTS

| | | | |
|---|---|---|---|
| 743721 | 10/1966 | Canada | 23/288 F |

*Primary Examiner*—Joseph Scovronek
*Assistant Examiner*—Bradley Garris
*Attorney, Agent, or Firm*—R. L. Phillips

[57] ABSTRACT

An internal combustion engine exhaust gas catalytic converter has a simplified basic construction—using only vertically disposed inner and outer louvered tubes defining a radial flow bead catalyst bed, and a pair of shell members embracing the upper and lower ends of the inner and outer tubes to retain the tubes and close the upper and lower ends of the catalyst bed. The shell members have an enlarged waist defining an outlet chamber surrounding the outer tube, and abut along radially-outwardly-directed axially-extending flanges which seal the outlet chamber and close the lower end of the inner tube to direct exhaust gases through the catalyst bed.

3 Claims, 6 Drawing Figures

CATALYTIC CONVERTER

This invention relates to a catalytic converter for use in a combustion engine exhaust system.

There have been various proposals, such as that of U.S. Pat. No. 3,950,139 issued Apr. 13, 1976 in the name of E. R. Cannon, for engine exhaust gas catalytic converters in which the exhaust gases flow radially through an annular bed of bead catalyst disposed in a vertical portion of the engine exhaust system.

This invention provides such a catalytic converter which is of considerably simplified construction. In a converter provided by this invention, the basic construction consists of only four pieces—inner and outer louvered tubes which define a catalyst bed, and a pair of shell members which embrace the upper and lower ends of the inner and outer tubes and have an enlarged waist surrounding the outer tube. The shell members retain the tubes, close the upper and lower ends of the catalyst bed, define and seal an outlet chamber surrounding the outer tube, and close the lower end of the inner tube to direct the exhaust gases through the catalyst bed. Various inlet and outlet fittings and support brackets, a fill plug, and a reservoir plate may be added to this basic construction to suit particular applications, and in further embodiments the outer tube or the inner and outer tubes may be formed in two parts to facilitate assembly.

The details as well as other objects and advantages of this invention are set forth in the remainder of the specification and are shown in the drawings in which.

Figure 1:
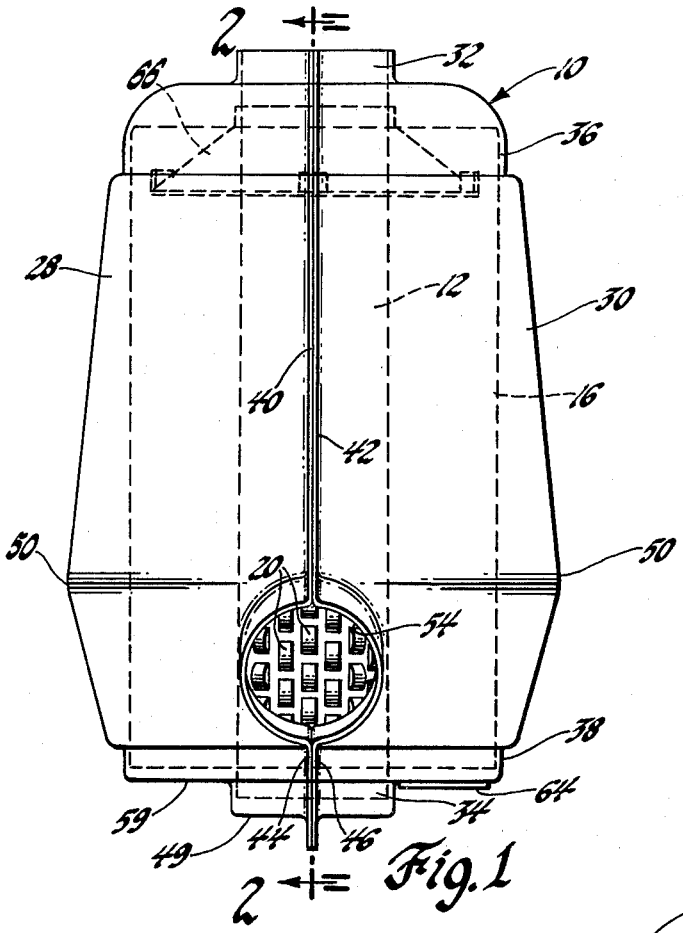
FIG. 1 is an elevational view of a converter provided by this invention.

Referring to FIGS. 1-4, an internal combustion engine exhaust gas catalytic converter 10 has a vertically disposed circular inner tube 12, the upper end 14 of which is adapted for connection to an engine exhaust pipe (not shown) to receive exhaust gases therefrom.

A circular outer tube 16 is concentric with and surrounds inner tube 12 to define a catalyst bed 18 therebetween. Inner and outer tubes 12 and 16 have louvers 20 formed therein to allow exhaust gases to flow substantially radially outwardly through catalyst bed 18.

It will be noted that the upper end 14 of inner tube 12 projects above the upper end 22 of outer tube 16 and that the lower end 24 of inner tube 12 projects below the lower end 26 of outer tube 16. A pair of die-formed inwardly concave shell members 28 and 30 are disposed on opposite sides of and surround tubes 12 and 16. Shell members 28 and 30 cooperate to form cylindrical neck regions 32 and 34 which snugly embrace the upper and lower ends 14 and 24 of inner tube 12. Shell members 28 and 30 also cooperate to form cylindrical shoulder regions 36 and 38 snugly embracing the upper and lower ends 22 and 26 of outer tube 16. Shell members 28 and 30 abut along radially-outwardly-directed axially-extending flanges which include short flange portions 40 and 42 and long flange portions 44 and 46, and continuous welds secure flange portion 40 to flange portion 42 and flange portion 44 to flange portion 46 while a further continuous weld 48 secures the neck region 32 of shell members 28 and 30 to the upper end 14 of inner tube 12. Weld 48 may also be used to secure a section of the engine exhaust pipe to inner tube 12, if so desired.

Shell members 28 and 30 extend beneath inner tube 12 and form an essentially flat surface 49 which closes the lower end 24 of inner tube 12 to direct exhaust gases radially outwardly through catalyst bed 18. Shell members 28 and 30 have an enlarged circular waist 50 intermediate shoulder regions 36 and 38 and surrounding outer tube 16 to define an outlet chamber 52 between outer tube 16 and shell members 28 and 30. As may be noted from FIGS. 1 and 2, the diameter of shell members 28 and 30 progressively increases from shoulder regions 36 and 38 to waist 50, while as may be noted from FIGS. 2 and 3, waist 50 is not concentric with outer tube 16. Outlet chamber 52 accordingly progressively increases in size from the right-hand side of FIG. 2 toward the left-hand side of FIG. 2 and from shoulder regions 36 and 38 to waist 50; this configuration facilitates flow of exhaust gases through outlet chamber 52 to a cylindrical outlet aperture 54 defined between shell members 28 and 30.

From the foregoing it will be appreciated that shell members 28 and 30 retain inner and outer tubes 12 and 16 in position and close the upper and lower ends 56 and 58 of catalyst bed 18. However, the lower end 24 of inner tube 12 is free to slide within neck region 34 to allow for differences in thermal expansion between inner tube 12 and shell members 28 and 30. Moreover, the upper and lower ends 22 and 26 of outer tube 16 are free to slide within shoulder regions 36 and 38 to allow for differences in thermal expansion between outer tube 16 and shell members 28 and 30.

Figure 2:
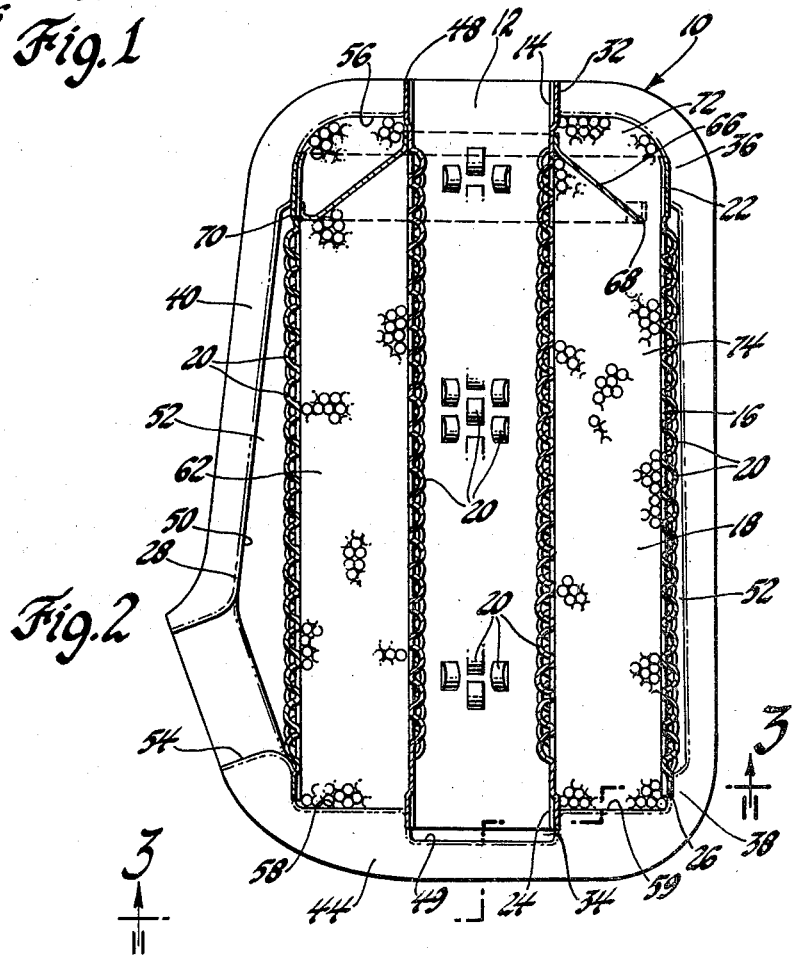
FIG. 2 is an axial sectional view, taken along line 2—2 of FIG. 1, showing the internal construction of that converter.
Figure 3:
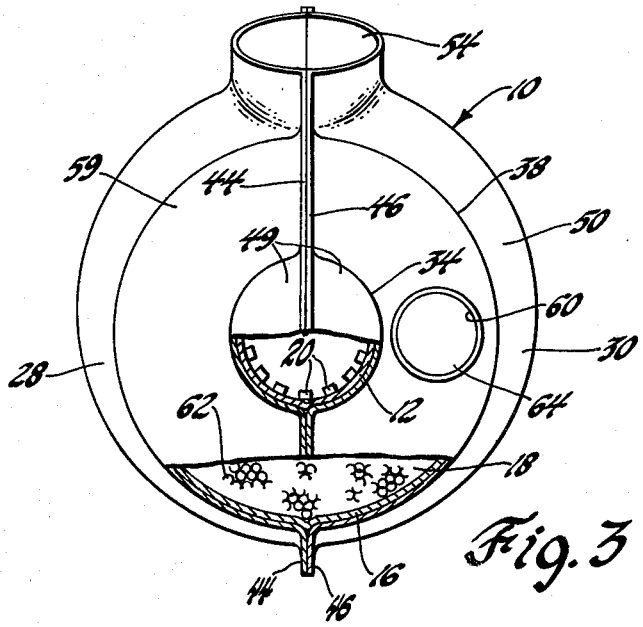
FIG. 3 is a bottom view of that converter with parts broken away as indicated by line 3—3 of FIG. 2 to further illustrate how the shell members embrace the inner and outer tubes.
Figure 4:
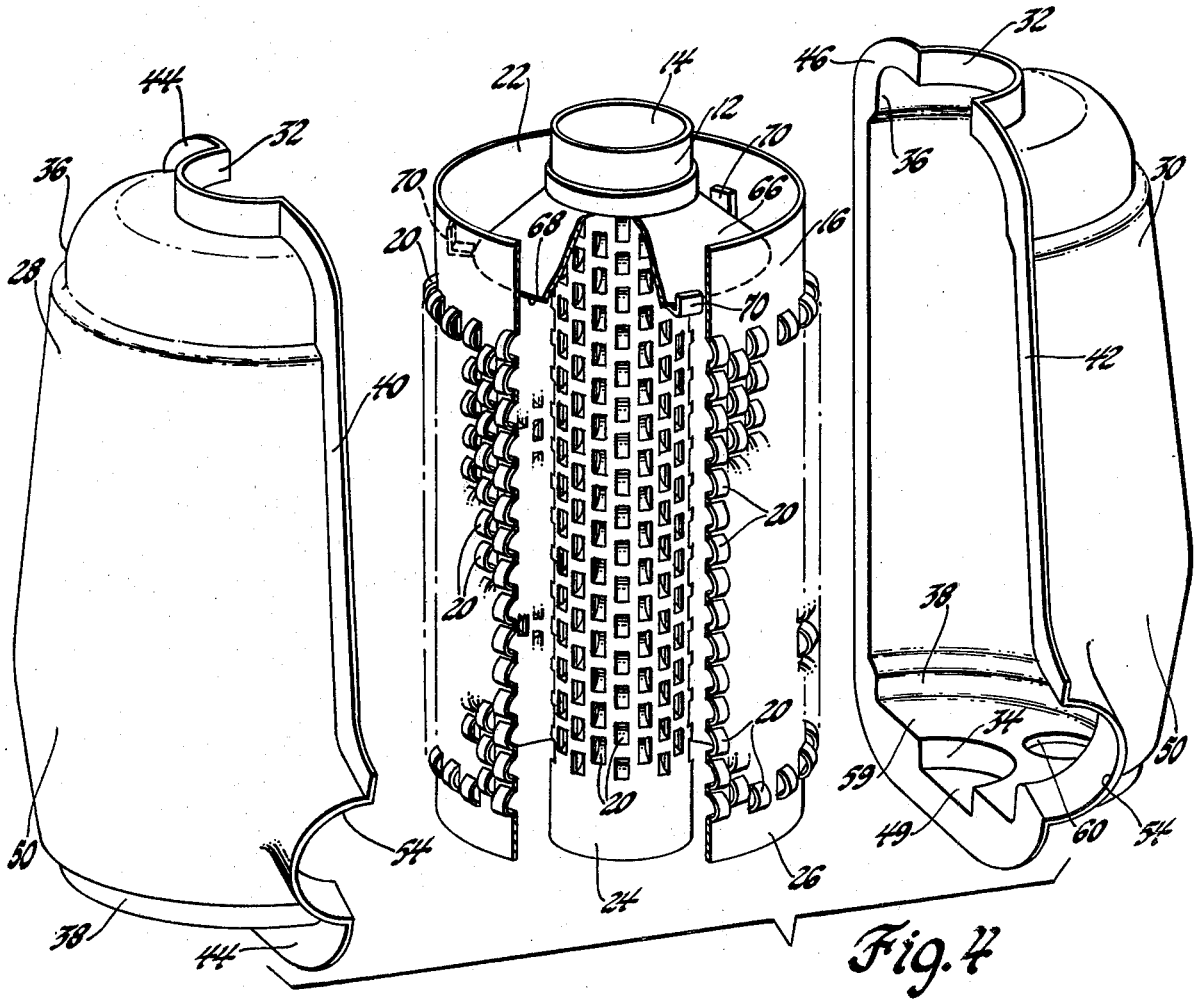
FIG. 4 is a view of that converter showing its parts prior to assembly of the shell members.

The upper end 22 of outer tube 16 is rolled in slightly, as shown in FIG. 2, to provide stiffening during the assembly process. In addition, the upper and lower ends of inner and outer tubes 12 and 16 dimple outwardly to fill the slight crevasses between flange portions 40 and 42 and between flange portions 44 and 46 during the assembly process to prevent loss of catalyst beads through the crevasses; as an alternative, separate strips of filler material could be disposed between flange portions 40 and 42 and between flange portions 44 and 46 at the upper and lower ends 56 and 58 of catalyst bed 18 and extending around into shoulder regions 36 and 38 to prevent loss of catalyst beads through the crevasses and to further stiffen the assembly.

The continuous welds along the flanges of shell members 28 and 30 seal outlet chamber 52. It will be noted that this construction does not permit any internal leakage path, between the inlet at the upper end 14 of inner tube 12 and the outlet aperture 54, which does not pass through catalyst bed 18 and accordingly exhaust gases may not bypass catalyst bed 18.

Shell members 28 and 30 form an essentially flat annular surface 59 at the lower end 58 of catalyst bed 18, and shell member 30 has an opening 60 through surface 59 to permit filling of bed 18 with catalyst beads 62 adapted to promote oxidizing and/or reducing reactions within the exhaust gases. The opening 60 is closed by a fill plug 64 of known construction, such as that shown in the aforementioned U.S. Pat. No. 3,950,139.

As taught by U.S. Pat. No. 3,950,139, a substantially frusto-conical reservoir plate 66 is secured to inner tube 12 above the louvers 20 formed therein and extends radially outwardly and downwardly to an outer rim 68 which is spaced inwardly from outer tube 16 and is located above the louvers 20 formed therein. Reservoir plate 66 may have one or more feet 70 contacting outer tube 16 to facilitate assembly. During operation, increasing temperatures within converter 10 will cause greater expansion of the metal tubes 12 and 16 and shell members 28 and 30 than of the catalyst beads 62 in bed 18. Beads 62 are then permitted to flow from the reservoir portion 72 of catalyst bed 18, above reservoir plate 66, into the gas flow portion 74 of catalyst bed 18, below reservoir plate 66, to keep gas flow portion 74 filled with beads; this inhibits bouncing of beads 62 in the exhaust gas stream and thus reduces loss of beads 62 due to attrition. As converter 10 cools after operation, beads will be displaced from gas flow portion 74 around plate 66 back into reservoir portion 72.

It will be appreciated that particular inlet and outlet fittings, together with appropriate support brackets, may be assembled to the upper end 14 of inner tube 12 and to outlet aperture 54 to connect converter 10 to other components of the engine exhaust system.

Figure 5:
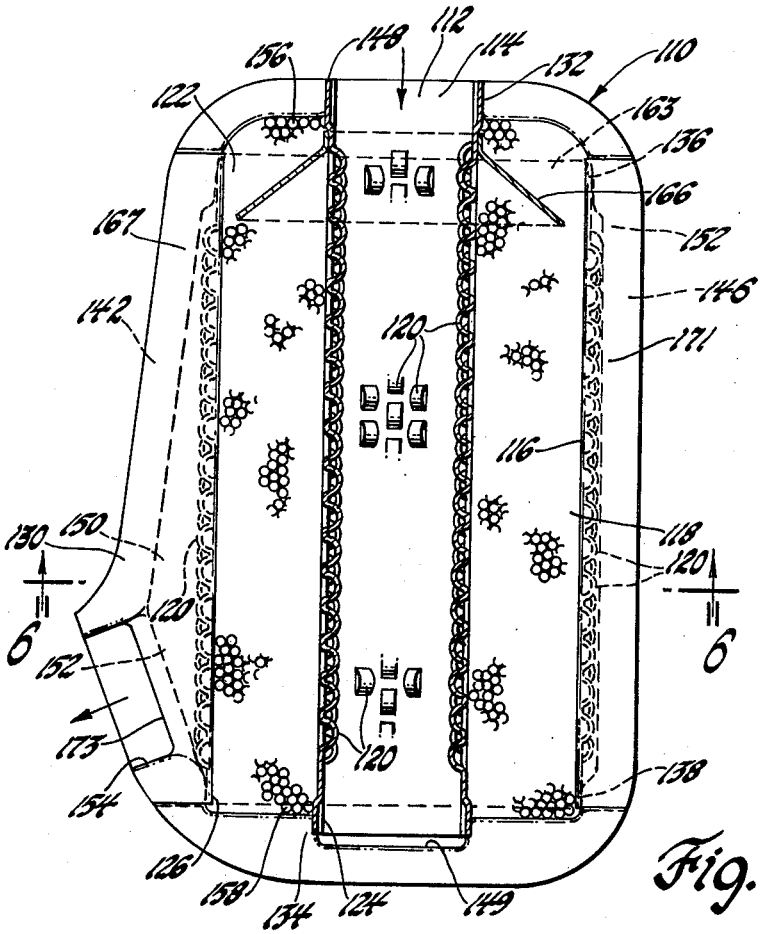
FIG. 5 is an axial sectional view, similar to that of FIG. 2, of another converter provided by this invention in which the outer tube is formed in two parts.
Figure 6:
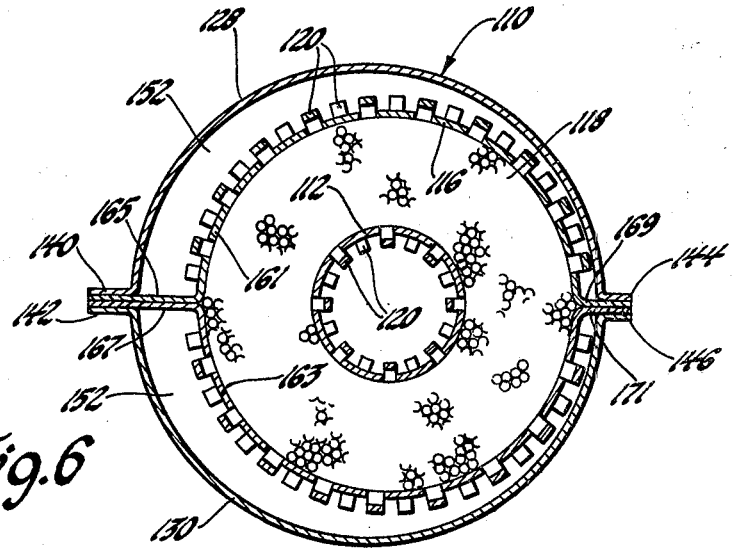
FIG. 6 is a sectional view, taken along line 6—6 of FIG. 5, showing flanges on the two-part outer tube retained between the shell members.

In the converter of FIGS. 1–4, inner and outer tubes 12 and 16 are made from sheets which have been rolled into the tube configuration after forming of the louvers 20. FIGS. 5–6 show an alternative embodiment in which the outer tube is made in two semi-circular parts.

The similarities between the catalytic converter 110 of FIGS. 5–6 and converter 10 shown in FIGS. 1–4 are evident. As shown in FIGS. 5–6, converter 110 has a vertically disposed circular inner tube 112 with an upper end 114 adapted to receive exhaust gases. A two-part circular outer tube 116 concentrically surrounds inner tube 112 to define a bed 118 of catalyst beads therebetween. Both inner and outer tubes 112 and 116 have louvers 120 to allow flow of exhaust gases radially outwardly through catalyst bed 118.

As in converter 10, the upper end 114 of inner tube 112 projects above the upper end 122 of outer tube 116 and the lower end 124 of inner tube 112 projects below the lower end 126 of outer tube 116. A pair of die-formed inwardly concave shell members 128 and 130 cooperate to form cylindrical neck regions 132 and 134 which embrace the upper and lower ends 114 and 124 of inner tube 112. Shell members 128 and 130 also cooperate to form cylindrical shoulder regions 136 and 138 embracing the upper and lower ends 122 and 126 of outer tube 116. Shell members 128 and 130 abut along flanges which include short portions 140 and 142 and long portions 144 and 146, and continuous welds secure flange portion 140 to flange portion 142 and flange portion 144 to flange portion 146. A further continuous weld 148 secures the neck region 132 of shell members 128 and 130 to the upper end 114 of inner tube 112.

Further as in converter 10, shell members 128 and 130 extend beneath inner tube 112 and form an essentially flat surface 149 which closes the lower end 124 of inner tube 112. Shell members 128 and 130 have an enlarged circular waist 150 surrounding outer tube 116 to define an outlet chamber 152 between outer tube 116 and shell members 128 and 130. The diameter of shell members 128 and 130 progressively increases from shoulder regions 136 and 138 to waist 150, while waist 150 is not concentric with outer tube 116; outlet chamber 152 accordingly progressively increases in size from the right side of FIGS. 5–6 toward the left side of FIGS. 5–6 and from shoulder regions 136 and 138 to waist 150. This configuration facilitates flow of exhaust gases through outlet chamber 152 to a cylindrical outlet aperture 154 defined between shell members 128 and 130.

Thus shell members 128 and 130 retain inner and outer tubes 112 and 116 in position and close the upper and lower ends 156 and 158 of catalyst bed 118.

As may be noted in FIG. 6, outer tube 116 is formed in two parts 161 and 163 that abut along radially-outwardly-directed axially-extending flanges which include left-hand flange portions 165 and 167 and right-hand flange portions 169 and 171. Right-hand flange portions 169 and 171 are retained between the long flange portions 144 and 146 of shell members 128 and 130, thereby bisecting the narrow region of outlet chamber 152. The lower ends of left-hand flanges 165 and 167 are also received between the long flange portions 144 and 146 while the upper ends of flanges 165 and 167 are received between the short flange portions 140 and 142 of shell members 128 and 130. The upper end of both left-hand flanges 165 and 167 and the right-hand flanges 169 and 171 extend into and bisect the upper shoulder region 136, while the lower end of both left-hand flanges 165 and 167 and right-hand flanges 169 and 171 extend into and bisect the lower shoulder region 138. Left-hand flanges 165 and 167 also extend completely through and bisect the largest portion of outlet chamber 152 but terminate along a line 173 to provide an undivided outlet aperture 154.

While forming outer tube 116 in two parts requires one component more than the converter 10 shown in FIGS. 1–4, the two-part construction may provide for easier assembly: in converter 10, either inner tube 12 must be disposed within outer tube 16 prior to nesting of outer tube 16 in one of the shell members 28 or 30 or inner tube 12 must be carefully inserted in outer tube 16 after outer tube 16 is nested in one of the shell members 28 or 30; in converter 110, on the other hand, the components may be nested sequentially by nesting outer tube part 161 in shell member 128, then nesting inner tube 112 in shell member 128, then nesting outer tube part 163 and shell member 130. Moreover, the reservoir plate 166 which is secured to inner tube 112 need not have any feet contacting outer tube 116.

It will be noted that the continuous welds along the flanges of shell members 128 and 130 also extend along the flanges of outer tube parts 161 and 163 both to seal outlet chamber 152 and to seal flange 165 to flange 167 and flange 169 to flange 171. As in converter 10, this construction does not permit any internal leakage path which does not pass through catalyst bed 118.

It will be appreciated that in a further embodiment the inner tube, as well as the outer tube, would be made in two parts.

From the foregoing it will be appreciated that both embodiments 10 and 110, and the further embodiment mentioned in the preceding paragraph, provide a radially flow bead catalyst converter having a considerably simplified, basically four-piece construction.

The embodiments of the invention in which an exclusive property or privilege is claimed are defined as follows:

1. A radial flow catalytic converter having a four-piece basic construction for use in a combustion engine exhaust system, said converter comprising a vertically disposed inner tube having an upper end for receiving exhaust gases, an outer tube coaxial with said inner tube and defining an annular space therebetween, said inner tube having its upper and lower ends projecting beyond the upper and lower ends of said outer tube, said inner and outer tubes having louvers formed therein permitting said exhaust gases to flow substantially radially outwardly through said annular space, a pair of inwardly concave shell members disposed on opposite sides of said tubes, said shell members having integral radially inwardly extending end portions cooperating to form cylindrical upper and lower neck regions respectively embracing the upper and lower ends of said inner tube while permitting substantially unrestricted lengthwise thermal expansion of the inner tube relative to the shell members and further cooperating to form cylindrical upper and lower shoulder regions respectively embracing the upper and lower ends of said outer tube while permitting substantially unrestricted lengthwise thermal expansion of the outer tube relative to the shell members to thereby retain said tubes and also close the upper and lower ends of said annular space to form a radial flow catalyst bed in cooperation with both said tubes while allowing for differences in lengthwise thermal expansion between both of the tubes and the shell members, said catalyst bed containing a plurality of catalyst beads adapted to promote an oxidizing and/or reducing reaction within said exhaust gases, said shell members further having an enlarged waist intermediate said shoulder regions and surrounding said outer tube to define an outlet chamber between said outer tube and said shell members, each of said shell members also having a radially-outwardly-directed axially-extending flange abutting the flange of the other shell member for sealing said outlet chamber and extending beneath the lower end of said inner tube for closing said inner tube and thereby directing said exhaust gases radially outward through said catalyst bed.

2. A radial flow catalytic converter having a four-piece basic construction for use in a combustion engine exhaust system, said converter comprising a vertically disposed circular inner tube having an upper end for receiving exhaust gases, a circular outer tube coaxial with said inner tube and defining an annular space therebetween, said inner tube having its upper and lower ends projecting beyond the upper and lower ends of said outer tube, said inner and outer tubes having louvers formed therein permitting said exhaust gases to flow substantially radially outwardly through said annular space, a pair of inwardly concave shell members disposed on opposite sides of said tubes, said shell members having integral radially inwardly extending end portions cooperating to form cylindrical upper and lower neck regions respectively embracing the upper and lower ends of said inner tube while permitting substantially unrestricted lengthwise thermal expansion of the inner tube relative to the shell members and further cooperating to form cylindrical upper and lower shoulder regions respectively embracing the upper and lower ends of said outer tube while permitting substantially unrestricted lengthwise thermal expansion of the outer tube relative to the shell members to thereby retain said tubes and also close the upper and lower ends of said annular space to form a radial flow catalyst bed in cooperation with both said tubes while allowing for differences in lengthwise thermal expansion between both of the tubes and the shell members, said catalyst bed containing a plurality of catalyst beads adapted to promote an oxidizing and/or reducing reaction within said exhaust gases, said shell members further having an enlarged circular waist intermediate said shoulder regions and surrounding said outer tube to define an outlet chamber between said outer tube and said shell members which increases in size from said shoulder regions to said waist, said waist being eccentric of said tubes whereby said outlet chamber increases in size from one side to the other side, said shell members further defining an outlet aperture opening from said other side of said outlet chamber adjacent said waist, each of said shell members also having a radially-outwardly-directed axially-extending flange abutting the flange of the other shell member for sealing said outlet chamber and extending beneath the lower end of said inner tube for closing said inner tube and thereby directing said exhaust gases radially outward through said catalyst bed.

3. A radial flow catalytic converter for use in a combustion engine exhaust system, said converter comprising a vertically disposed circular inner tube having an upper end for receiving exhaust gases, a pair of semi-circular outer tube parts cooperating to form a circular outer tube coaxial with said inner tube and defining an annular space between said outer tube and said inner tube, said inner tube having its upper and lower ends projecting beyond the upper and lower ends of said outer tube, said inner and outer tubes having louvers formed therein permitting said exhaust gases to flow substantially radially outwardly through said annular space, a pair of inwardly concave shell members disposed on opposite sides of said tubes, said shell members having integral radially inwardly extending end portions cooperating to form cylindrical upper and lower neck regions respectively embracing the upper and lower ends of said inner tube while permitting substantially unrestricted lengthwise thermal expansion of the inner tube relative to the shell members and further cooperating to form cylindrical upper and lower shoulder regions respectively embracing the upper and lower ends of said outer tube while permitting substantially unrestricted lengthwise thermal expansion of the outer tube relative to the shell members to thereby retain said tubes and also close the upper and lower ends of said annular space to form a radial flow catalyst bed in cooperation with both said tubes while allowing for differences in lengthwise thermal expansion between both of the tubes and the shell members, said catalyst bed containing a plurality of catalyst beads adapted to promote an oxidizing and/or reducing reaction within said exhaust gases, said shell members further having an enlarged waist intermediate said shoulder regions and surrounding said outer tube to define an outlet chamber between said outer tube and said shell members, each of said shell members also having a radially-outwardly-directed axially-extending flange abutting the flange of the other shell member for sealing said outlet chamber and extending beneath the lower end of said inner tube for closing said inner tube and thereby directing said exhaust gases radially outward through said catalyst bed, each of said outer tube parts also having a radially-outwardly-directed axially-extending flange abutting the flange of the other outer tube part, said outer tube flanges being received between and retained by said shell member flanges.

* * * * *